US007021033B2

(12) United States Patent
Close et al.

(10) Patent No.: US 7,021,033 B2
(45) Date of Patent: Apr. 4, 2006

(54) CONTAINER STRAP CUTTING METHOD

(75) Inventors: Donald R. Close, Fairfax, VA (US); Mark Bankard, Sykesville, MD (US); William D. Finch, New Windsor, MD (US); Robert Cutlip, Millersville, MD (US); Robert D. Lundahl, Frederick, MD (US); Dwight Koogle, Middletown, MD (US)

(73) Assignee: United States Postal Service, Washington, DC (US)

( * ) Notice: Subject to any disclaimer, the term of this patent is extended or adjusted under 35 U.S.C. 154(b) by 0 days.

(21) Appl. No.: 10/441,875

(22) Filed: May 19, 2003

(65) Prior Publication Data

US 2003/0196417 A1 Oct. 23, 2003

Related U.S. Application Data

(62) Division of application No. 10/161,155, filed on May 30, 2002, now Pat. No. 6,604,337.

(60) Provisional application No. 60/294,000, filed on May 30, 2001.

(51) Int. Cl.
*B65B 43/40* (2006.01)

(52) U.S. Cl. ..... 53/492; 53/381.2; 53/381.4

(58) Field of Classification Search ..... 414/412, 414/414, 411; 29/564.3; 53/492, 381.2, 53/381.4

See application file for complete search history.

(56) References Cited

U.S. PATENT DOCUMENTS

| | | | | |
|---|---|---|---|---|
| 2,820,282 | A * | 1/1958 | Schneider, Jr. | 53/381.2 |
| 3,777,455 | A | 12/1973 | Allen | |
| 3,896,607 | A | 7/1975 | Royal | |
| 3,913,300 | A | 10/1975 | Benzing | |
| 4,317,319 | A | 3/1982 | Price | |
| 4,390,313 | A * | 6/1983 | Hoehn | 53/381.2 |
| 4,466,767 | A | 8/1984 | Meschi | |
| 4,838,751 | A * | 6/1989 | Hanaya et al. | 414/412 |
| 5,048,259 | A | 9/1991 | Cox et al. | |
| 5,105,527 | A * | 4/1992 | Miyata | 29/564.3 |
| 5,179,878 | A | 1/1993 | Kranefeld et al. | |
| 5,318,399 | A * | 6/1994 | Marom | 414/412 |
| 5,375,316 | A * | 12/1994 | Carlson et al. | 29/564.3 |
| 5,406,690 | A * | 4/1995 | Neilsen et al. | 29/564.3 |
| 5,419,095 | A * | 5/1995 | Yohe | 53/381.2 |
| 5,657,617 | A | 8/1997 | Allen et al. | |
| 5,813,199 | A | 9/1998 | Temburg | |
| 5,894,711 | A | 4/1999 | Davidson et al. | |
| 6,098,373 | A * | 8/2000 | Ashikawa et al. | 53/381.2 |

FOREIGN PATENT DOCUMENTS

| | | | | |
|---|---|---|---|---|
| JP | 3-148433 | * | 3/1991 | 414/412 |

* cited by examiner

*Primary Examiner*—John Sipos
(74) *Attorney, Agent, or Firm*—Lucius L. Lockwood; Lewis and Roca LLP

(57) ABSTRACT

A device is disclosed that can automatically remove lids from trays and place lids on trays. Further the device can sense the presence of a lid on a tray and can sense the dimensions of the tray. Based on the sensed dimensions of the tray, the device can select an appropriate sized lid to place on the tray. In one embodiment of the invention, a device holds a lid with a lid manipulator having lid holders. At least one end mechanism is attached to at least one end of the lid manipulator, and the end mechanism folds the lid flaps of an appropriate lid. Guided by the lid manipulator, lids are then positioned on the tray.

22 Claims, 6 Drawing Sheets

CONTAINER STRAP CUTTING METHOD

CROSS-REFERENCE TO RELATED APPLICATIONS

This application is a division of Ser. No. 10/161,155, filed on May 30, 2002, now U.S. Pat. No. 6,604,337 which claims priority from U.S. Provisional Application No. 60/294,000 filed on May 30, 2001, entitled "Automatic Lidder and/or Un-Lidder System and Method." The contents of the above application is relied upon and expressly incorporated by reference as if fully set forth herein.

STATEMENT REGARDING FEDERALLY SPONSORED RESEARCH OR DEVELOPMENT

The invention was made by an agency of the United States government or under a contract with an agency of the United States government, the United States Postal Service ("USPS" or "Postal Service"), an independent establishment of the executive branch of the U.S. government.

BACKGROUND OF THE INVENTION

1. Field of the Invention

The invention relates generally to handling, routing and shipping containers. More specifically, the invention relates to systems and methods for automatically placing lids on, and removing lids from, shipping containers.

2. Description of the Related Art

It has been a common practice in the shipping and package delivery industry to ship items in trays such as flat trays and SPBS trays (tubs). Items such as letters and packages are placed in trays, a lid is put on them, and a strap is bound around the tray and lid assembly. One reason for this practice is to protect items from damage and loss during shipping. Also, storing and stacking uniform assemblies is more efficient in terms of time and space, than storing disparate items.

However, putting lids on trays and strapping the assembly at an intermediate location, only to have the strap cut and lids taken off so items can be further routed, is a time consuming and repetitive task. Typically, this task is done manually. A worker receives the assembly, manually cuts the strap, removes the lid, unfolds the lid, sorts and stacks the lid according to size, and feeds the un-lidded tray to the next station. Then, after the items have undergone the required processing at the intermediate location, a worker reverses this time consuming process. The worker selects the appropriate size lid for the tray, folds it, places it on the tray, puts a strap on the assembly, and feeds it to the next station. This manual process is both time-consuming and expensive. Further, the manual process subjects workers to the hazards associated with physically handling a cutter and a large numbers of trays. An automated process to place lids on trays and to remove lids from trays would provide an advantage over a manual system.

One problem associated with putting lids on trays has been that items tended to get damaged when the lids are placed on the tray. The unfolded lids usually have four flaps, each corresponding to a tray side, in the finished assembly. Two opposing outside flaps remain outside of the tray and the other two opposing inside flaps reside inside the tray between the items and tray sides. Problems arise, however, because the inside flaps can jam against items, such as letters, that are close to the edges of the tray. In the past, careful attention was needed to ensure that items were not damaged when lids were put on trays.

One problem associated with putting lids on trays has been that items tended to get damaged when the lids are placed on the tray. The unfolded lids usually have four flaps, each corresponding to a tray side, in the finished assembly, two opposing outside flaps remain outside of the tray and the other two opposing inside flaps reside inside the tray between the items and tray sides. However, problems arise because the inside flaps can jam against items, such as letters, that are close to the edges of the tray. In the past, careful attention was needed to ensure that items were not damaged when lids were put on trays.

Accordingly, there is a need for an automated system and method for putting lids on trays and for removing lids from trays. A need also exists for a system that can perform these functions without damaging items in the trays, and to be fed into a device that will put a strap around the assembly. It would be desirable to provide a method that obtains the advantages of the present system while minimizing the need for expensive automated equipment.

SUMMARY OF THE INVENTION

In certain embodiments of the present invention there is provided a method and systems that can automatically put lids on and remove lids from different tray sizes or from a single tiny size. In one embodiment of the invention, a lidding device with a lid manipulator having lid holders holds a lid. Lids are held by a lid holder and at least one end mechanism attached at the end of the lid manipulator, where the cud mechanism folds the lid flaps of an appropriate sized lid. Guided by the lid manipulator, lids are positioned on the tray. Trays are passed through the lidding device by automatic means such as a conveyor belt or mechanized rollers. A fist advantage of the present invention is the automated handling of trays and lids.

According to another embodiment of the invention, a sensor on the lidding device sizes a tray/lid combination. When removing lids from trays, information from the sensor about the tray/lid dimension allows the lid holders to adapt to different sizes. When attaching lids, the sensor allows the lidding device to match the appropriate sized lid to a given tray. Appropriate unfolded lids are selected from a storage container. The unfolded lid flaps are folded and the lid is guided onto a tray. Thus one advantage of the invention is that a single lidding device can handle trays and lids of differing dimensions. It is not necessary to provide a single machine that is adapted to a single tray/lid size.

A further advantage of the invention is that straps which attach lids to trays may be automatically cut. The trays pass by a cutter that is part of the lidding device. The cutter shears the straps thus releasing the lids from the trays.

Another advantage of the present invention is the high rate at which trays may pass through the lidding device. The automated process of removing lids and attaching lids to trays assures that an acceptably high rate.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claim. It is to be understood that both the foregoing general description and the following detailed description are exemplary and explanatory only and are not restrictive of the invention, as claimed. Thus, the present invention comprises a combination of features, steps, and advantages which enable it to overcome various deficiencies of the prior art. The various characteristics described above, as well as other features, will be readily apparent to those skilled in the art upon reading the following detailed description of the preferred embodiments of the invention, and by referring to the accompanying drawings. The accompanying drawings, which are incorporated in and constitute a part of this specification, illustrate embodiments of the invention and, together with the description, serve to explain the principles of the invention.

BRIEF DESCRIPTION OF THE DRAWINGS

For a more detailed description of a preferred embodiment of the present invention, reference will now be made to the accompanying drawings, which form a part of the specification, and wherein.

DETAILED DESCRIPTION OF THE PREFERRED EMBODIMENT

Reference will now be made in detail to exemplary embodiments of the invention, examples of which are illustrated in the accompanying drawings. Wherever possible, the same reference numbers will be used throughout the drawings to refer to the same or like parts.

Figure 1:
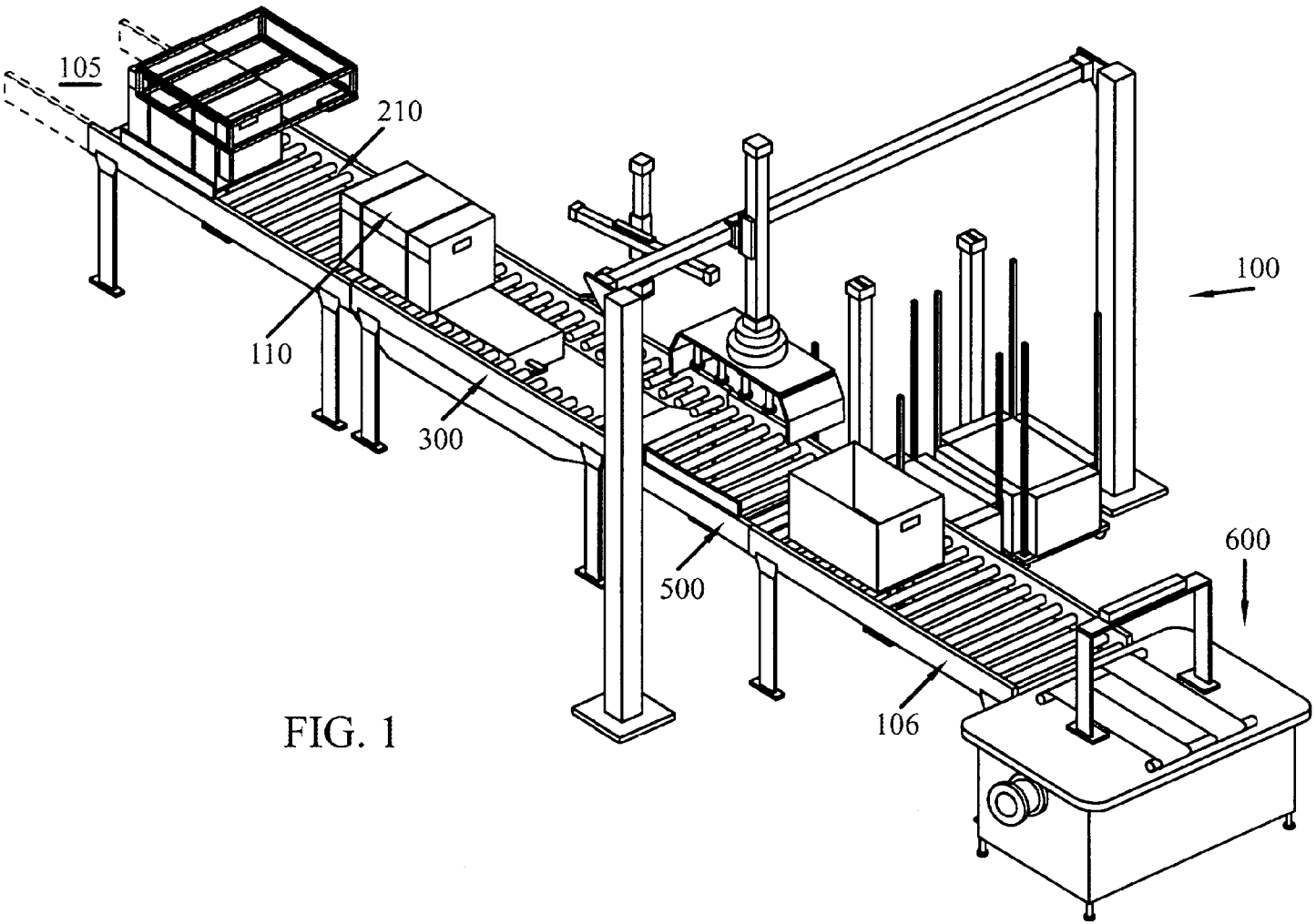
FIG. 1 is an overview of the Lidder/Un-Lidder.

Referring initially to FIG. 1 there is shown an embodiment of the present invention comprising a lidding device 100, or Lidder/Un-Lidder system or Lidder on Un-Lidder. In one embodiment, the Lidder/Un-Lidder has a single module which incorporates all functions in a self-contained system. The single module may contain separate subsystems. Subsystem stations of lidding device 100 include tray transport/tray sizing/lid detection station 200 seen in FIG. 2 destrapping station 300, lid station 500, and tray exit/strapper 600. As shown in FIG. 1 the linear arrangement of lidding device 100 allows a workpiece to pass through the device, passing as it does, each of the subsystem stations. In an alternative arrangement the lidding device may be arrange in an L-shaped configuration.

This embodiment of FIG. 1 places input conveyor 105 and exit conveyor 106 in a parallel configuration so that the system is conveniently connected with straight sections of a power roller conveyor 210. This configuration also minimizes the amount of floor space required. Lidder/Un-Lidder 100 can be made to accept different tray sizes that are being transported. Tray transport is accomplished with a power roller, zero pressure accumulation conveyor 210 providing an interface to both upstream and downstream conveyors. Because the Lidder/Un-Lidder never lifts a tray 110, Lidder/Un-Lidder can handle heavy trays, with weights, for example, of 70 lbs. or more.

The embodiment of Lidder/Un-Lidder 100 shown in FIG. 1 can be configured to put lids on or take lids off There is a discrete point at which the operation can be changed from lidding to unlidding or vice-versa. Trays will have lids installed or trays will have lids removed. In either mode of operation the system can be designed to accommodate a random mix of tray types. In certain embodiments, Lidder/Un-Lidder 100 has a multiple station approach to maximize tray throughput. This allows trays to keep flowing so that each tray operation (for example, tray sizing, strap removal, lid installation or removal, lid retrieval and stacking, and tray strapping) is kept simple and is performed at a discrete station. This allows different operations to be performed at the same time, and on a succession of trays. In this manner, lidding device 100 may operate simultaneously on multiple trays that are located at separate stations. Once the system is primed, the tray throughput rate is gated at the longest single in-line operation.

As an example, the system can have a throughput performance of about an average of 20 trays per minute, measured over a one hour period, with a minimum threshold average of 15 trays per minute over one hour. In operation, for example, the system could have less than four unplanned stoppages per hour that require intervention by a human operator.

Figure 2:
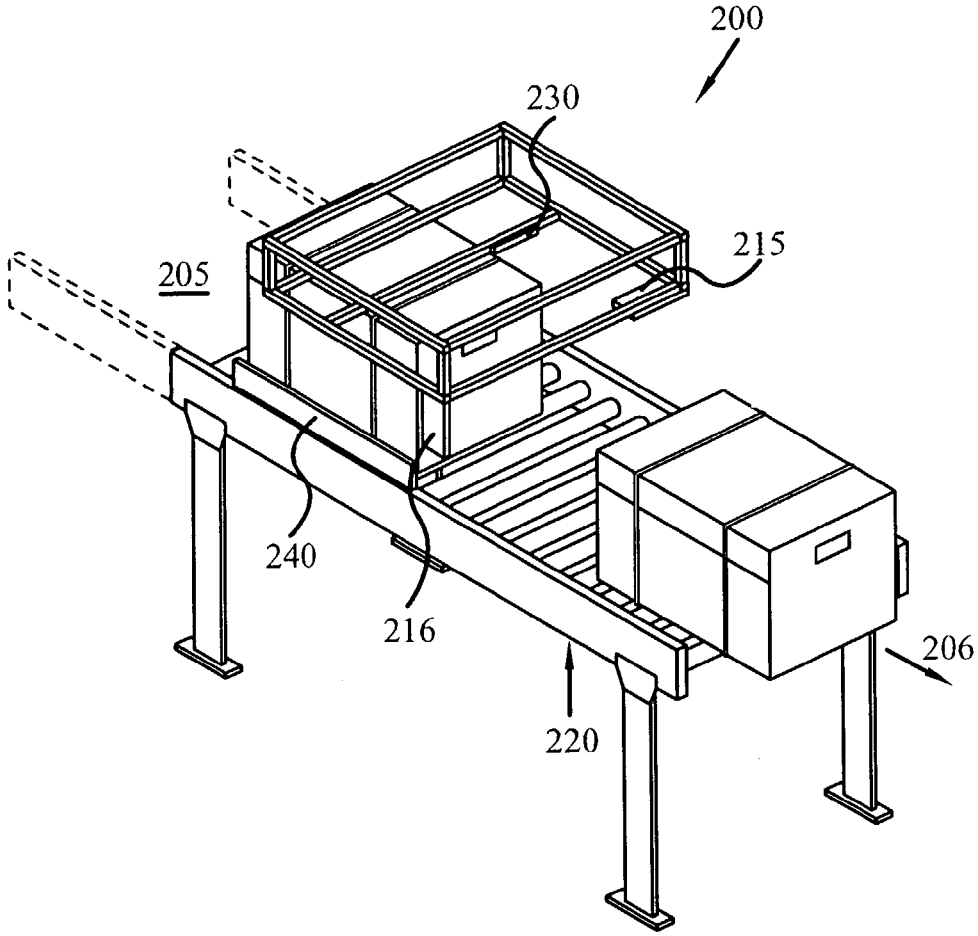
FIG. 2 is a diagram of the tray transport, tray sizing and lid detection station.

Tray transport 200, as shown in FIG. 2, is accomplished with a power roller, zero pressure accumulation conveyor 210 seen in FIG. 1. In an embodiment, this type of conveyor is quiet. Conveyor 210 is integrated with the facility's conveyor upstream 205 and downstream 206, and will maintain the same height above the floor, usually between 36" to 72." A mail catcher 220, to catch any random mailpiece that may fall from a tray, may be positioned beneath conveyor 210.

In one embodiment the transport conveyor station is approximately 5 feet in length and comprises two 30 inch zones. Interoll 24:1 high output DC brush motors may be used to provide conveyor 210. Intelliveyor controls for the brush motors, also from Interoll, may be used. The average conveyor speed is approximately 75 to 125 fpm.

Also shown in FIG. 2 is a tray sizing and lid detection operation, which is accomplished during tray transport. A set of horizontal 215 and vertical 216 discrete sensors are used to logically determine the tray size from dimensions. In an embodiment, the discrete sensors are discrete Photo Reflective zone sensor arrays. In certain embodiments, lid detection sensors 230 are used to determine if a lid is present on a tray. In an embodiment, lid detection sensors 230 are ultrasonic sensors. Ultrasonic sensors direct an ultrasonic wave at a tray and, depending on the reflected signal, determine if a lid is present. Ultrasonic sensors are much less expensive than other types of sensors. In another embodiment (not shown), a video camera can image the top of the trays as they pass through the system. A commercially available image processing board mounted in a control computer can analyze the acquired image and make a determination as to the presence of a lid and/or straps.

Information acquired by ultrasonic sensors or video cameras is combined with tray sizing data and provides inputs into the control system to control the operation.

Also shown in FIG. 2 is tray referencing pusher 240. Large differences in the width of different types of trays requires that the trays be referenced on the conveyor. A pneumatic pusher, when acting as referencing pusher 240, places trays against a common side of conveyor 210.

Figure 3:
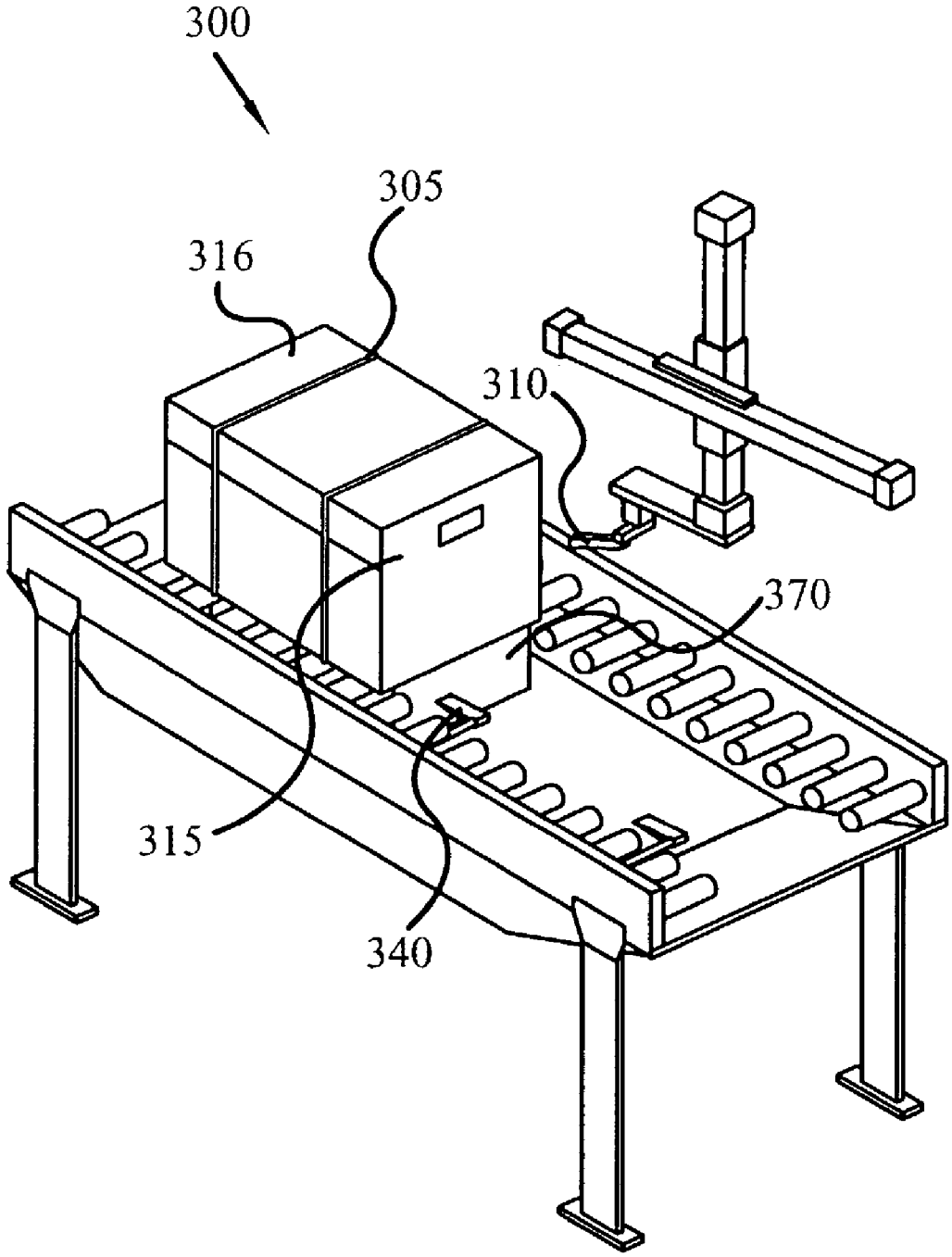
FIG. 3 is a diagram of the unstrapping station.

Referring now to FIG. 3, a de-strapping station 300 is shown. In a certain embodiment the de-strapping station cuts and pulls off strap 305. In certain embodiments, this is done simultaneously. Cut straps can be fed to a vacuum take-away and storage system or dropped into a bin.

Figure 4:
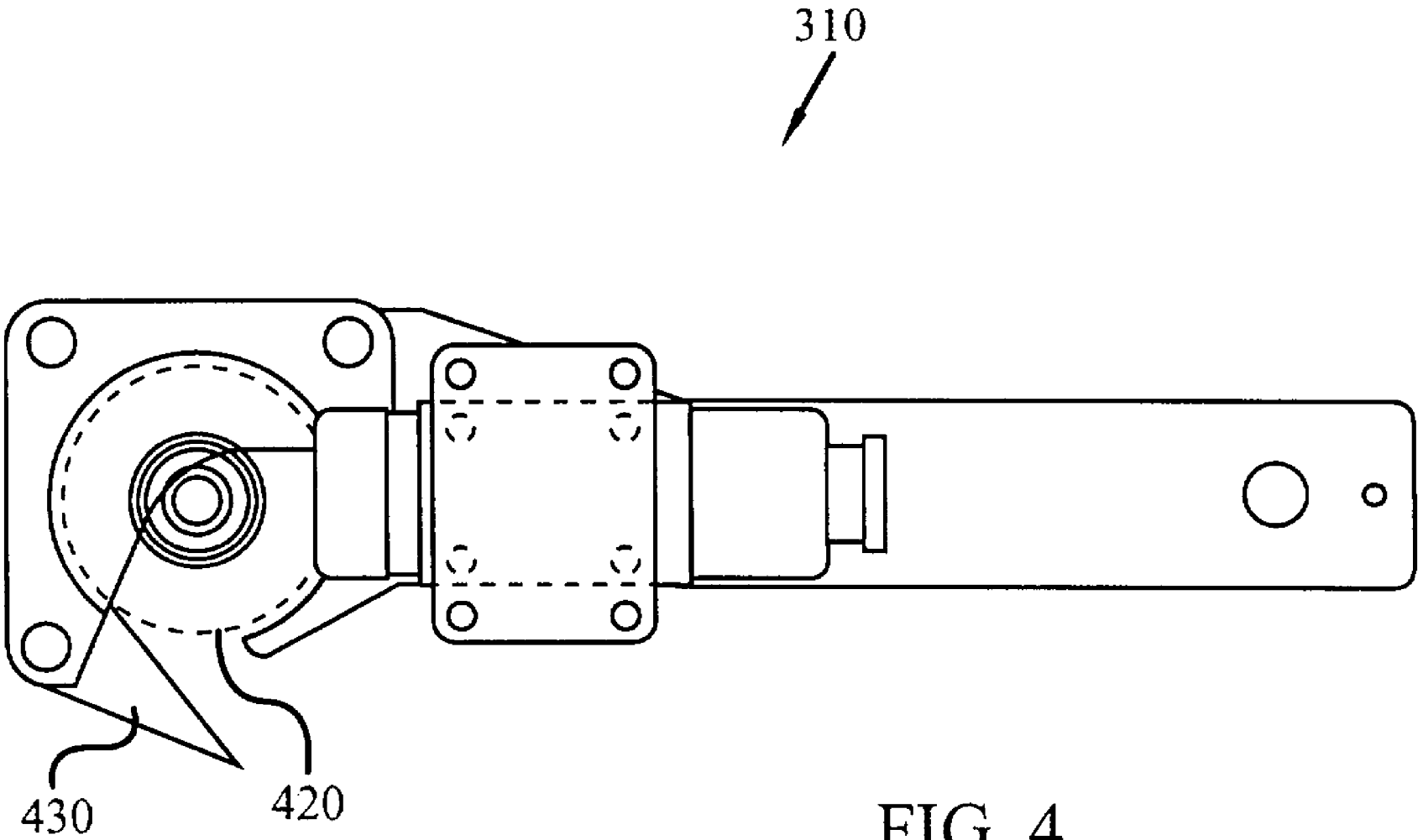
FIG. 4 is a side view of the rotating saw blade.

A Strap cutter 310 cuts strap 305. The cut strap then falls and is pulled through a de-strap window (not shown) into a storage system (also not shown). In an embodiment shown in FIG. 4, strap cutter 310 includes a rotating saw blade 420 and a flexible spatula 430. Strap 305 is picked up off the surface of tray 315 by flexible spatula 430 and guided to the rotating saw blade 420 as the assembly is fed through the system. Rotating saw blade 420 cuts through strap 305 when contact is made. In another embodiment, spatula 430 is not flexible. In another embodiment, strap 305 is cut by an ordinary box cutter blade affixed adjacent to spatula 430.

To facilitate the strap cutting operation, the conveyor system may include a tray stop 370 that prevents a tray from sliding in a direction that opposes the cutting operation. Thus, for example, a tray stop may compose a flange of material that prevents a tray from sliding in the direction opposite the movement of the conveyor. Tray stop 370 ensures that the de-strapping operation occurs simultaneously with movement of trays along the conveyor.

In certain embodiments, strap cutter 310 includes a simple hooked blade in combination with flexible spatula 430. In this embodiment, strap 305 is similarly picked up off the surface of tray 315 by flexible spatula 430. In this embodiment, strap 305 is guided over the backside of simple hooked blade. A cutting edge on simple hooked blade cuts strap 305 as the assembly is fed through the system. The cutting edge or blade that severs the snap may be a hooked blade, a straight blade, a curved blade or a circular blade.

In certain embodiments, a bottom mechanism 340 provides high speed assurance that the cut strap is pulled clear from tray 315, and fed to the vacuum take-away system. Bottom mechanism 340 acts essentially as a hook, flexible or inflexible, by which to catch loose straps and pull them away from the tray as the tray passes over the bottom mechanism 340. The strap removal function is done below the tray to take advantage of the natural falling tendency of the cut strap. In other embodiments, there is no positive strap removal mechanism. In yet other embodiments, strap removal is done from the sides or top of tray 315.

In operation strap cutter 310 may be brought to engage a tray and strap through several methods, either singly or in combination. In one embodiment strap cutter 310 is held in an essentially static position. The tray is itself brought into position for strap cutter 310 to effectively cut strap 305 by tray referencing pusher 240. Alternatively, strap cutter 310 may be mounted in a biasing device, such as a spring-loaded mechanism or a hydraulic mechanism, such that strap cutter 310 is biased against an edge of tray 315 as the tray passes the de-strapping station. In another alternative, strap cutter 310 may be positioned on a moveable arm or housing. The arm or housing may swing, rotate, or make lateral movement so as to bring strap cutter 310 into engagement with tray 315 as it passes.

In certain embodiments, strap cutter 310 and bottom mechanism 340 of the strap takeaway mechanism utilize similar designs. They are constructed as offset X-Y manipulators with a pair of rod less pneumatic cylinders mounted in an "L" configuration. The ends of each manipulator share a similar design, employing flexible spatula 430 which is brought in contact with tray 315 (both top and bottom) and engages strap 305 by sliding between strap 305 and a lid 316.

In certain embodiments, strap cutter 310 and bottom mechanism 340 of the strap takeaway mechanism utilize similar designs. They are constructed as offset X-Y manipulators with a pair of rodless pneumatic cylinders mounted in an "L" configuration. The ends of each manipulator share a similar design, employing flexible spatula 410 which is brought in contact with tray 315 (both top and bottom) and engages strap 305 by sliding between strap 305 and a lid 316.

In an embodiment of the present invention, the strap take-away system (not shown) is a vacuum powered device which sucks the fallen cut straps down a passage to a reusable vacuum canister. This technique is reliable, high speed, jam proof, and requires little precision. The strap collection canister is mounted remotely for easy access and can utilize a standard and reusable container with a vacuum blower unit used as a lid. Cut straps need not be removed from the container, rather only the container need be changed out.

In certain embodiments, an integral strap chopping system is used, In this embodiment the fallen cut straps are put through a chopper before entering the strap collection canister.

In certain other embodiments, straps are dropped into a collection canister below the strap removal section 300.

Figure 5:
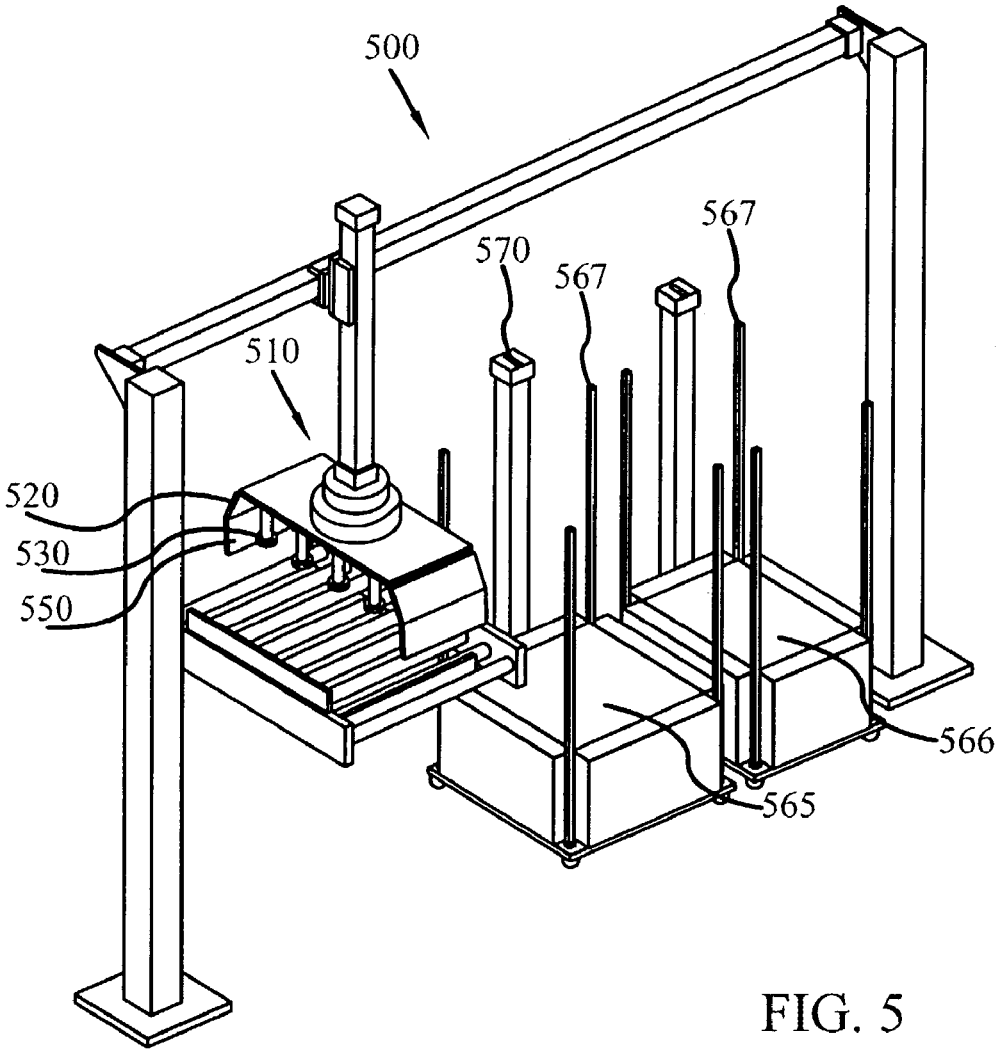
FIG. 5 is a diagram of the lid station.

Referring now to FIG. 5 there is shown a lid station 500. Lid station 500 comprises a lid manipulator 510 to install and remove lids. In the embodiment shown, lid manipulator 510 is slidably-attached to a cross-beam. In certain embodiments of the present invention, lid manipulator 510 and the cross-beam are a two-axis mechanism made with extrusions and rodless pneumatic cylinders. Lid manipulator 510 and the cross-beam are joined so at to allow both vertical and horizontal movement of lid manipulator 510. An end of arm tool 520, at end of lid manipulator 510, is equipped with lid holders 530, for example, suction cups with a vacuum supplied by a set of venturi-style vacuum generators. End of arm tool 520 is mounted to an end of lid manipulator 510. Lid holders may also comprise other devices such as pins, hooks, grips, clamps, and expandable pins, capable of grasping a lid.

Figure 6:
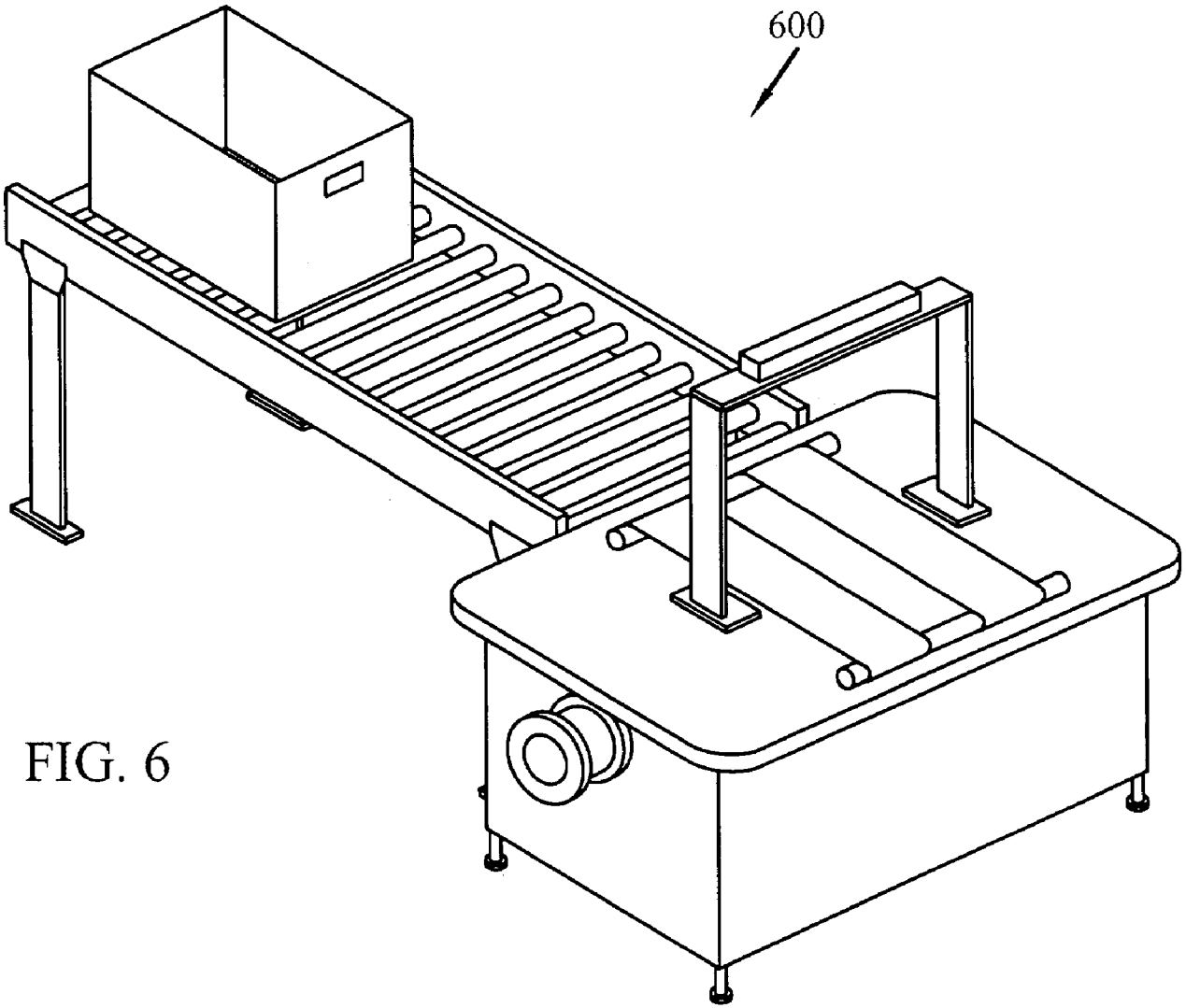
FIG. 6 is a diagram of the strapper.

Based on tray size as determined earlier by discrete sensors 215 and 216, an appropriate unfolded lid is chosen from sorted lids in storage stacks 565 and 566. Lid holders 530 grip and position the appropriate unfolded lid. End mechanisms 550 on end of arm tool 520 contact at least two of the unfolded lid flaps and fold the two flaps toward each other as lid manipulator 510 gently guides the lid flaps between items and the tray sides. When lid manipulator 510 has reached a preset distance from the tiny, end mechanisms 550 unfold until the entire mechanism has reached the proper height to engage the fray sides. Once the lidding operation is complete the lid manipulator 510 is lifted away from the lidded tray. The lidded tray is then fed to a strapper 600, as shown in FIG. 6.

In certain embodiments, lid manipulator 510 can accumulate both lidding and unlidding operations. The end of arm tool 520 can perform other insertion articulations as well. The end of arm tool 520 can also be constructed to not have the lid flap manipulators 510 for unlidding only.

In certain embodiments, two removable storage stacks 565 and 566 bold sorted lids 440 for different tray sizes. Lids are placed into a retriever from storage stacks 565 and 566 depending on the operation being performed. Lid storage stacks 565 and 566 are stored adjacent to the conveyor. Floor fixtures 567 are used to locate storage stacks 565 and 566. In addition, a height sensor 570, such as a photo eye, is used to sense height of stacked lids. While only two storage racks are shown, the lidder device can operate with one stack, or more than two stacks of lids.

During operating activities at lid station 500 lids are removed from trays or lids are placed on trays. When operating in lidding mode, lidding device 100 automatically selects the appropriate-sized lid for the tray based on sensor-measured dimensions of the tray. Lid manipulator 510 is moved horizontally to the appropriate lid-storage stack 565 and 566, the stack with the size lid that matches the tray in operation. Lid manipulator 510 then moves vertically such that end of arm tool 520 in cooperation with lid holders 530 grasps a lid. Upon grasping the lid, lid manipulator 510 moves vertically and horizontally so as to place the lid on the tray. End of arm tool 520 thereupon releases the lid. End mechanisms 550 may fold lid edges or flaps so that lid edges are tucked into the tray or outside the tray. In a preferred embodiment, end mechanisms 550 are designed so that end mechanisms operate on opposing edges of a tray at one time, for example the front and back edges, or the right and left edges. When lid manipulator 510 and end mechanisms 550 have, for example, folded and tucked a front and back pair of edges on a tray, lid manipulator 510 can, in a successive operation, radially rotate 90 degrees so as to bring end mechanisms 550 into position to operate on the remaining pair of edges, the right and left pair. In this manner end mechanisms 550 may successively fold and tuck pairs of lid edges.

When the system operates in unlidding mode, lid manipulator 510 removes lids from trays and places the removed lids in lid-storage stacks 565 and 566. This operation begins with end of arm tool 520, in cooperation with lid holders 530, grasping a lid to be removed. Lid manipulator 510 thereupon moves vertically and horizontally so as to place the lid in the appropriate storage stack 565 and 566. At that point end of arm tool 520 releases the lid, and lid manipulator 510 returns to operate on the next tray. If needed, end mechanisms 550 may also operate on the lid edges or flaps so as to unfold the edges. In the meantime the tray from which the lid has been removed has been carried by the conveyor system to the next station.

Referring now to FIG. 6 there is shown tray exit station 600. A commonly available automatic strapper is mounted in the out feed conveyor line. The strapper will operate in automatic mode when the system is in lidding mode. The strapper will move to bypass mode when the system is in unlidding mode.

In certain embodiments, Lidder/Un-Lidder System 100, with the exception of a control enclosure, is completely enclosed in a safety enclosure, eliminating accidental contact with moving components. This enclosure incorporates a standard industrial machine guarding fence. Tray openings at the infeed and outfeed conveyors allow ingress and egress of the trays and the tray openings can be sized to allow all tray sizes to pass through. The tray openings are spaced far enough away from any mechanism so that a person reaching in cannot have their hand in the danger zone. Hinged panels are provided in the fence enclosure at key locations to allow access by personnel to deal with problems and perform maintenance. These panels are equipped with standard industrial interlocks that generate on emergency stop (E-stop) condition if opened. This condition should not automatically reset when the panel is closed. Rather positive operator action can be required to restart the system.

In certain embodiments, E-stops (not shown) are provided on the outside of the safety enclosure for example, at least at each panel, tray opening and at a control panel. In an embodiment, E-stops are placed all around the perimeter such that one is never more than a few feet away and one never has to reach over equipment to access it. The E-stop switches, for example are standard industrial, "mushroom", illuminated red, latched buttons mounted in a standard electrical box. A reset switch is mounted in the same standard electrical box. The E-stop is pulled out to enable a reset, and the reset switch is activated to allow a restart. Certain E-stops are also equipped with restart switches. This allows the operator to restart the system after a procedure such as clearing a jam without having to cross the conveyor back to the control panel.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. One of ordinary skill in the art will recognize that the process just described may easily have steps added, taken away, or modified without departing from the principles of the present invention. Accordingly, the scope of protection is not limited to the embodiments described herein, but is only limited by the claims which follow, the scope of which shall include all equivalents of the subject matter of the claims.

What is claimed is:

1. A method comprising the steps of:

transporting a container by a conveyor in contact with a bottom surface of the container;

moving a segment of a strap away from a first surface of the container using an object that is offset from the inside of the container, the first surface located on a side of the container other than the container's bottom surface;

cutting the strap with a cutter that is offset from the inside of the container on a side of the container other than the container's bottom surface;

pulling the cut strap away from the container's bottom surface;

removing the cut strap downwardly away from the container's bottom surface; and removing a lid from the container.

2. The method of claim 1, further comprising, prior to the step of cutting the strap, the step of transporting the container in a direction approximately perpendicular to the strap such that the strap makes contact with the object.

3. The method of claim 1, further comprising, prior to the step of cutting the strap, the step of moving the object in a direction approximately perpendicular to the strap such that the strap makes contact with the object.

4. The method of claim 1, wherein the first surface is on the top of the lid.

5. The method of claim 1, wherein the pulling step is performed by a second object offset from the inside of the container.

6. The method of claim 5, wherein the pulling step is performed by a pair of rotary rollers.

7. The method of claim 1, wherein the object is selected from the group consisting of a flexible spatula, an inflexible spatula, and a wedge situated on and between the strap and the first surface.

8. The method of claim 1, wherein the step of cutting the strap cuts the strap at the segment.

9. The method of claim 1, wherein the step of cutting the strap with a cutter offset from the inside of the container is selected from the group consisting of:

holding the cutter in a static position and moving the container as the cutter cuts the strap;

biasing the cutter as the cutter cuts the strap;

moving the cutter into the engagement with the strap as the container is moving; and a combination of the steps of the group.

10. The method of claim 1, wherein the cutter is selected from the group consisting of a rotating saw blade, a box cutter blade affixed to the object, a hooked blade in combination with the object, a hooked blade that is the opposite side of the object, a straight blade, a curved blade, and a circular blade.

11. An apparatus comprising means for performing the step of the transporting, means for performing the step of moving, means for performing the step of the cutting, and means for performing the steps of the removing as defined in the method of claim 1.

12. A method comprising:

transporting a container along a conveying surface, a bottom surface of the container in contact with the conveying surface, the container having a plurality of sides and an opening covered by a lid that is secured to the container by a strap on the lid and one or more the sides of the container;

moving a segment of the strap away from the inside of the container with an object located outside of the container on a side of the container other than the container's bottom surface;

cutting the segment of the strap on a side of the container other than the container's bottom surface such that the lid is unsecured from the top of the container;

removing the cut strap downwardly away from the container's bottom surface; and removing the lid from the opening of the container.

13. The method of claim 12, wherein prior to the cutting, the strap is continuous and the cutting of the segment renders the strap discontinuous.

14. The method of claim 12, further comprising detecting the presence of the strap and moving the object to the detected strap.

15. The method of claim 12, wherein the cutting is performed with a cutter selected from the group consisting of a rotating saw blade, a box cutter blade affixed to the object, a hooked blade in combination with the object, a hooked blade that is the opposite side of the object, a straight blade, a curved blade, and a circular blade.

16. The method of claim 12, further comprising stacking the removed lid with other said removed lids.

17. An apparatus comprising means for performing the transporting, means for performing the moving, means for performing the cutting and means for preforming the removing the strap and the lid as defined in the method of claim 12.

18. A method comprising:

transporting each of a plurality of containers single file along a conveying surface, wherein the containers:

are of variable sizes and weights; and each have a plurality of sides and an opening covered by a lid that is secured to the top of the container by a strap and a bottom side in contact with the conveying surface;

for each said container while being transported along the conveying surface:

detecting the location of the strap;

moving a segment of the detected strap away from the inside of the container by using an object that is outside of the container on one of the plurality of sides other than the bottom side;

cutting the segment of the strap on one of the plurality of sides other than the bottom side;

removing the cut strap downwardly away from the container's bottom surface; and removing the lid from the opening of the container, stacking each said removed lid with other said removed lids.

19. The method of claim 18, wherein prior to the cutting, the strap is continuous and the cutting of the segment renders the strap discontinuous.

20. The method of claim 19, further comprising detecting the presence of the continuous strap and moving the object to the detected continuous strap.

21. The method of claim 18, wherein the cutting is performed with a cutter selected from the group consisting of a rotating saw blade, a box cutter blade affixed to the object, a hooked blade in combination with the object, a hooked blade that is the opposite side of the object, a straight blade, a curved blade, and a circular blade.

22. An apparatus comprising means for performing the transporting, means for performing the detecting, means for performing the moving, means for performing the cutting, means for performing the removing of the cut strap, means for preforming the removing the lid, and means for performing the stacking as defined in the method of claim 18.

* * * * *

UNITED STATES PATENT AND TRADEMARK OFFICE

CERTIFICATE OF CORRECTION

PATENT NO. : 7,021,033 B2
APPLICATION NO. : 10/441875
DATED : August 9, 2005
INVENTOR(S) : Donald R. Close et al.

It is certified that error appears in the above-identified patent and that said Letters Patent is hereby corrected as shown below:

In column 2,
at line 3, please cancel the text beginning with "One problem associated" and ending with "put on trays." at line 13;
at line 26, "systems" should read --system--;
at line 28, "tiny" should read --tray--;
at line 32 "cud" should read --end--; and,
at line 36, "fist" should read --first--.

In column 5,
at line 23, "snap" should read --strap--; and,
at line 59, please cancel the text beginning with "In certain embodiments," to and ending with "and a lid 316." at column 5, line 67.

In column 6,
at line 41, "tiny" should read --tray--;
at line 43, "fray" should read --tray--;
at line 51, "manipulators" should read --manipulator--;
at line 53, "bold" should read --hold--; and,
at line 53 please delete the reference number "440".

In column 9, line 5, the first occurrence of the word "step" should read --steps--.

Signed and Sealed this

Sixth Day of March, 2007

JON W. DUDAS
*Director of the United States Patent and Trademark Office*

UNITED STATES PATENT AND TRADEMARK OFFICE

CERTIFICATE OF CORRECTION

PATENT NO. : 7,021,033 B2
APPLICATION NO. : 10/441875
DATED : April 4, 2006
INVENTOR(S) : Donald R. Close et al.

It is certified that error appears in the above-identified patent and that said Letters Patent is hereby corrected as shown below:

In column 2,
at line 3, please cancel the text beginning with "One problem associated" and ending with "put on trays." at line 13;
at line 26, "systems" should read --system--;
at line 28, "tiny" should read --tray--;
at line 32 "cud" should read --end--; and,
at line 36, "fist" should read --first--.

In column 5,
at line 23, "snap" should read --strap--; and,
at line 59, please cancel the text beginning with "In certain embodiments," to and ending with "and a lid 316." at column 5, line 67.

In column 6,
at line 41, "tiny" should read --tray--;
at line 43, "fray" should read --tray--;
at line 51, "manipulators" should read --manipulator--;
at line 53, "bold" should read --hold--; and,
at line 53 please delete the reference number "440".

In column 9, line 5, the first occurrence of the word "step" should read --steps--.

This certificate supersedes Certificate of Correction issued March 6, 2007.

Signed and Sealed this

Twenty-seventh Day of March, 2007

JON W. DUDAS
*Director of the United States Patent and Trademark Office*